US006707882B2

(12) United States Patent
Bittner et al.

(10) Patent No.: US 6,707,882 B2
(45) Date of Patent: Mar. 16, 2004

(54) X-RAY TUBE HEAT BARRIER

(75) Inventors: Todd Russell Bittner, Chicago, IL (US); Qing Kelvin Lu, Aurora, IL (US); Paul Mingwei Xu, Oswego, IL (US)

(73) Assignee: Koninklijke Philips Electronics, N.V., Eindhoven (NL)

( * ) Notice: Subject to any disclaimer, the term of this patent is extended or adjusted under 35 U.S.C. 154(b) by 90 days.

(21) Appl. No.: 09/992,274

(22) Filed: Nov. 14, 2001

(65) Prior Publication Data

US 2003/0091148 A1 May 15, 2003

(51) Int. Cl.[7] ..... H01J 35/10
(52) U.S. Cl. ..... 378/130; 378/141
(58) Field of Search ..... 378/130, 141, 378/127, 121, 144, 143, 142

(56) References Cited

U.S. PATENT DOCUMENTS

| | | | | |
|---|---|---|---|---|
| 3,735,176 A | * | 5/1973 | Langer et al. | 378/125 |
| 3,753,021 A | | 8/1973 | Braun | 313/60 |
| 4,210,371 A | | 7/1980 | Gerkema et al. | |
| 4,335,327 A | | 6/1982 | Waugh et al. | 313/330 |
| 4,431,355 A | | 2/1984 | Junemann | |
| 4,641,332 A | | 2/1987 | Gerkema | |
| 4,674,109 A | | 6/1987 | Ono | |
| 5,077,775 A | | 12/1991 | Vetter | |
| 5,090,041 A | | 2/1992 | Furbee | |
| 5,150,398 A | | 9/1992 | Nishioka et al. | |
| 5,224,142 A | | 6/1993 | Ono et al. | |
| 5,384,818 A | | 1/1995 | Ono et al. | |
| 5,553,114 A | | 9/1996 | Siemers et al. | |
| 5,809,106 A | | 9/1998 | Kitade et al. | |
| 5,875,227 A | | 2/1999 | Bhatt | |
| 5,978,447 A | | 11/1999 | Carlson et al. | 378/132 |
| 6,002,745 A | | 12/1999 | Miller et al. | 378/128 |
| 6,125,169 A | * | 9/2000 | Wandke et al. | 378/143 |
| 6,477,231 B2 | * | 11/2002 | Snyder et al. | 378/130 |

FOREIGN PATENT DOCUMENTS

| | | |
|---|---|---|
| EP | 565 005 | 10/1993 |
| EP | 0 952 605 | 10/1999 |
| FR | 2675628 | 10/1992 |
| JP | 02-144836 | 6/1990 |

* cited by examiner

*Primary Examiner*—Louis Arana
(74) *Attorney, Agent, or Firm*—Fay, Sharpe, Fagan, Minnich & McKee, LLP

(57) ABSTRACT

An x-ray tube (1) includes a heat shield (130) which intercepts heat radiating from an anode (10), thereby reducing the temperature of a bearing assembly (62). The heat shield includes outer and inner concentric cylinders (132, 134) spaced from each other by a vacuum gap (138). The heat shield and a stationary portion (114) of the bearing assembly are both connected to a cold plate (150) so that heat is not conducted from the cylinders to the bearing assembly but is instead carried away by the cold plate to the surrounding cooling oil.

20 Claims, 8 Drawing Sheets

X-RAY TUBE HEAT BARRIER

BACKGROUND OF THE INVENTION

The present invention pertains to the vacuum tube arts, and in particular to a heat barrier for an x-ray tube. It finds particular application in conjunction with rotating anode x-ray tubes for CT scanners and will be described with particular reference thereto. However, it is to be appreciated that the present invention will also find application in the generation of radiation and in vacuum tubes for other applications.

Conventional diagnostic uses of x-radiation include shadowgraphic projection images of the patient on x-ray film or electronic pick-up, fluoroscopy, in which a visible real time shadowgraphic image is produced by low intensity x-rays impinging on a fluorescent screen after passing through the patient, and computed tomography (CT) in which projection images from many directions are electrically reconstructed into a volume reconstruction. A high powered x-ray tube is rotated about a patient's body at a high rate of speed to generate the projection images.

A high power x-ray tube typically includes a thermionic cathode and an anode, which are encased in an evacuated envelope. A heating current, commonly of the order of 2–5 amps, is applied through a filament or thin layer to create a surrounding electron cloud. A high potential, of the order of 100–200 kilovolts, is applied between the cathode and the anode to accelerate the electrons from the cloud towards the anode. The electrons are focused into an electron beam which impinges on a small area of the anode, or target area, with sufficient energy to generate x-rays. X-radiation is emitted from the anode and focused into a beam, typically through a beryllium window.

The acceleration of electrons causes a tube or anode current of the order of 5–200 milliamps. Only a small fraction of the energy of the electron beam is converted into x-rays, the majority of the energy being converted to heat which heats the anode white hot.

In high energy tubes, the anode rotates relative to the cathode at high speeds during x-ray generation to spread the heat energy over a large area and inhibit the target area from overheating. Due to the rotation of the anode, the electron beam does not dwell on the small impingement spot of the anode long enough to cause thermal deformation. The diameter of the anode is sufficiently large that in one rotation of the anode, each spot on the anode that was heated by the electron beam has substantially cooled before returning to be reheated by the electron beam.

The anode is typically rotated by an induction motor. The induction motor includes driving coils, which are placed outside the evacuated envelope, and a rotor supported by a bearing assembly, within the envelope, which is connected to the anode. When the motor is energized, the driving coils induce electric currents and magnetic fields in the rotor which cause the rotor to rotate.

The temperature of the anode can be as high as 1,400° C. Part of the heat is transformed through the vacuum by radiation. Part of the heat is transferred by conduction to the rotor, and to the bearings assembly. Heat travels through the bearing shaft to the bearing races and is transferred to the lubricated bearing balls in the races. The lubricants, typically lead or silver, on the bearing balls become hot and tend to evaporate.

One way to reduce bearing temperatures is to provide a thermal block to isolate the bearing lubricant from the heat of the target. A variety of thermal blocks have been developed for reducing the flow of heat from the anode to the bearing shaft. In one low power design, the rotor stem is brazed to a steel rotor body liner that is then screwed to the bearing shaft. This provides a slightly more thermally resistive path.

Another thermal block that has been used in the industry is known as a top-hat design. A top hat-shaped piece of low thermal conductivity material, such as Hastelloy™ or Inconel™, is screwed onto the hub of the x-ray bearing shaft. The rotor body is then attached to the brim of the top hat with screws, welds, or other fastening means. The thermal conduction path from the rotor body to the bearing is then extended by the length of the top hat. Analysis shows that a 20–50° C. temperature decrease may be achieved at the front bearing race when the top hat design is employed. Another thermal block uses a thin molybdenum cone with a highly reflective surface which is pinned to the stem connecting the target with the bearing assembly. The cone follows the contours the target, blocking the view of the target from the bearing assembly. The cone reflects heat radiating from the target, reducing the radiative mode of heat transfer to the bearing assembly.

Another method of reducing heat flow is to use a spiral groove bearing shaft. The spiral groove bearing is a relatively complex, large bearing that employs a gallium alloy to transfer heat. The bearing shaft is limited to a rotational speed of about 60 Hz. This limits operating power of the x-ray tube.

A trend toward shorter x-ray exposure times in radiography has placed an emphasis on having a greater intensity of radiation and hence higher electron currents. Increasing the intensity can cause overheating of the x-ray tube anode. As such higher power x-ray tubes are developed, the diameter and the mass of the rotating anode continues to grow. Further, when x-ray tubes are combined with conventional CT scanners, a gantry holding the x-ray tube is rotated around a patient's body in order to obtain complete images of the patient. Today, typical CT scanners revolve the x-ray tube around the patient's body at a rate of between 60–120 rotations-per-minute (RPM). This increased rotation speed has resulted in increased stresses on the rotor stem and bearing shaft. For the x-ray tube to operate properly, the anode needs to be supported and stabilized from the effects of its own rotation and, in some instances, from centrifugal forces created by rotation of the x-ray tube about a patient's body.

One way to reduce these stresses to a non-critical level is to reduce the length of the rotor stem while increasing the cross sectional area. This, however, shortens and widens the heat conduction path from the target to the bearing shaft, resulting in higher thermal transfer. Recently, x-ray tubes have been developed in which the anode surrounds the bearing shaft, as shown, for example, in U.S. Pat. No. 5,978,447. However, many of the conventional types of thermal radiation blocks, such as the cone design, are unsuited to use in such a configuration, since there is no stem to which a cone may be attached.

The present invention provides a new and improved x-ray tube and method which overcomes the above-referenced problems and others.

SUMMARY OF THE INVENTION

In accordance with one aspect of the present invention, an x-ray tube is provided. The x-ray tube includes an envelope which encloses an evacuated chamber. A cathode disposed within the chamber provides a source of electrons. An anode disposed within the chamber is positioned to be struck by the electrons and generate x-rays. A bearing assembly is surrounded by the anode, the bearing assembly including a stationary portion and a rotatable portion. The rotatable portion is connected with the anode and rotates with the anode relative to the stationary portion during operation of the x-ray tube. A heat shield between the bearing assembly and the anode reduces the radiative transfer of heat from the anode to the bearing assembly.

In accordance with another aspect of the present invention, an x-ray tube is provided. The x-ray tube includes an envelope which defines an evacuated chamber. A cathode is disposed within the chamber for providing a source of electrons. An anode is disposed within the chamber and positioned to be struck by the electrons and generate x-rays. A bearing assembly is concentrically aligned with the anode. The bearing assembly includes a rotating portion connected with the anode by a shaft and a stationary portion thermally connected with a heat sink outside the envelope. A first generally concentric heat shield is between the anode and the bearing assembly. A second generally concentric heat shield is between the first heat shield and the bearing assembly.

In accordance with another aspect of the present invention, a method of operating an x-ray tube is provided. The method includes supporting a rotating anode on a bearing assembly. The bearing assembly is received through a central opening in the anode such that the bearing assembly extends forward and rearward of a center of gravity of the anode. The method further includes interposing a heat shield between the anode and the bearing assembly, operating the x-ray tube such that the anode generates x-rays and radiates heat towards the bearing assembly, and intercepting a portion of the heat radiated from the anode with the heat shield.

In accordance with another aspect of the present invention, an x-ray tube is provided. The x-ray tube includes an evacuated housing and a cold plate mounted to the housing. A cylindrical bearing assembly is mounted to the cold plate. An anode is mounted on the bearing assembly for rotation relative to the housing. A first generally cylindrical heat shield is mounted to the cold plate. The first heat shield extends between and spaced from the anode and the bearing assembly to intercept radiant thermal energy traveling from the anode toward the bearing assembly. A cathode is disposed in the housing opposite to the anode.

One advantage of at least one embodiment of the present invention is that radiative heat transfer from an anode target to a bearing assembly of an x-ray tube is reduced.

Another advantage of at least one embodiment of the present invention is that it centers the center of gravity of the target on the bearing assembly of the x-ray tube.

Another advantage of at least one embodiment of the present invention is that bearing life is increased.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
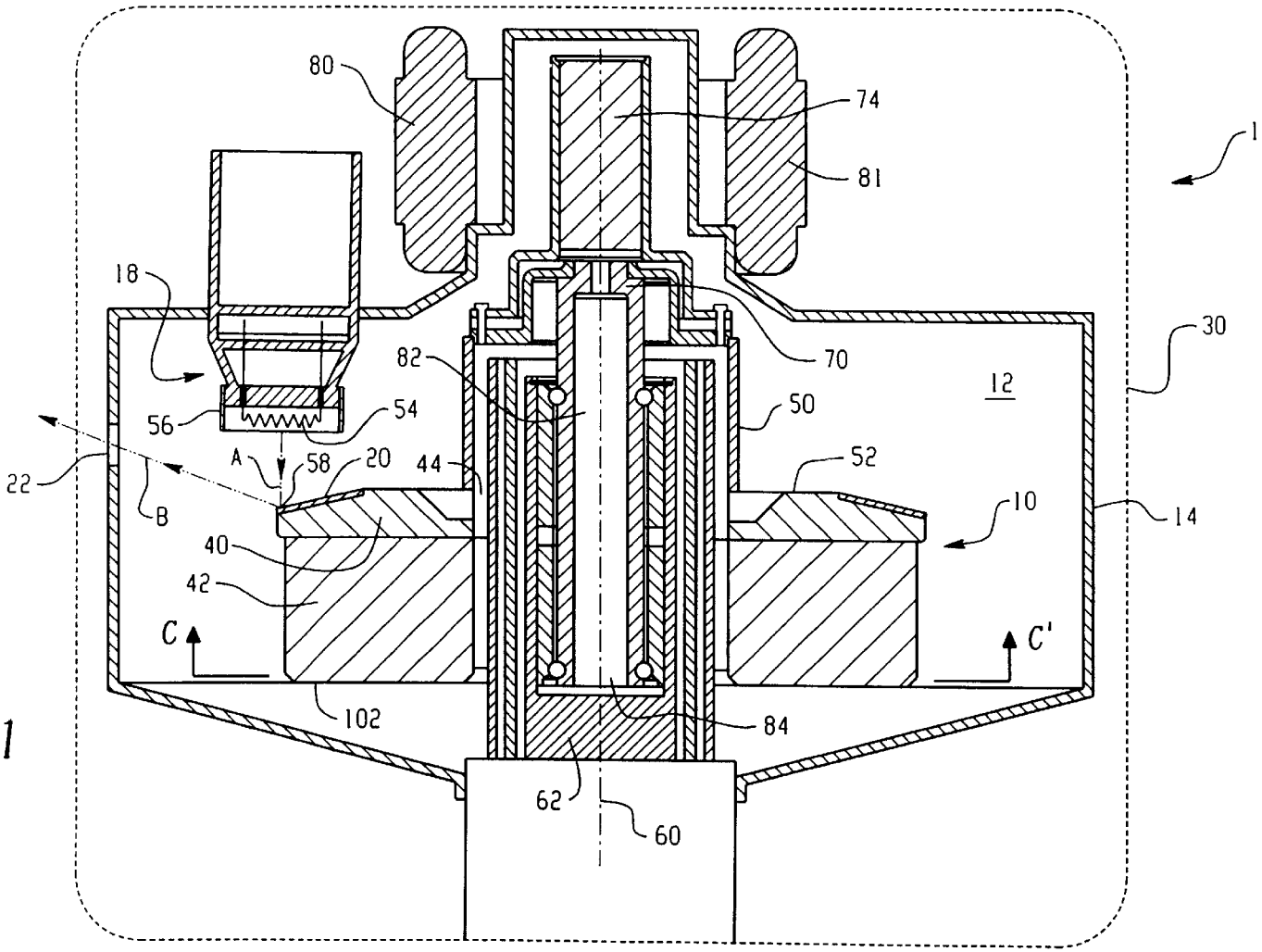
FIG. 1 is a schematic sectional view of a rotating anode x-ray tube according to the present invention.

With reference to FIG. 1, a rotating anode x-ray tube 1 of the type used in medical diagnostic systems, such as CT scanners, for providing a beam of x-ray radiation is shown. The tube includes an anode 10 which is rotatably mounted in an evacuated chamber 12, defined by an envelope or frame 14, typically formed from glass, ceramic, or metal. A heated element cathode assembly 18 within the envelope supplies and focuses an electron beam A. The cathode is biased, relative to the anode, such that the electron beam flows to the anode and strikes a target area 20 of the anode. A portion of the beam striking the target area is converted to x-rays B, which are emitted from the x-ray tube through a window 22 in the envelope. A housing 30 filled with a heat transfer and electrically insulating fluid, such as oil, surrounds the envelope.

The anode 10 is shown as having a front plate or disc 40, formed from a molybdenum alloy, and a back heat radiating plate 42 formed from graphite. The front plate 40 of the anode includes an annular portion defining the target area 20, which is made of a tungsten and rhenium composite in order to aid in the production of x-rays. It will be appreciated, however, that other single or multiple piece anode configurations made of any suitable substances could alternatively be used. The anode is in the form of an annulus, with a central bore 44. A generally cylindrical elongated neck portion 50 extends forward a front surface 52 of the front plate, as described in more detail below (the terms "forward" and "rearward," and the like are used herein to denote items which are closer to and further away from the cathode, respectively). The neck portion, preferably, has limited thermal conductivity.

The cathode assembly includes a cathode filament 54 mounted within a cathode focusing cup 56, which is energized to emit the electrons which are accelerated to the anode assembly 10 to produce x-radiation for diagnostic imaging, therapy treatment, and the like. The cathode focusing cup 56 serves to focus the electrons emitted from the cathode filament 54 to a focal spot 58 on the anode target area. In a preferred embodiment, the cathode focusing cup 56 is at an electrical potential of about −75,000 volts with respect to ground, and the anode assembly 10 is at an electrical potential of about +75,000 volts with respect to ground, the potential difference between the two components thus being about 150,000 volts. Impact of the electrons from the cathode filament 54 onto the target area causes the anode assembly 10 to be heated to between about 1100° C. and 1400° C.

The x-ray tube anode assembly 10 is mounted for rotation about an axis 60 via a bearing assembly shown generally at 62. More specifically, the front plate 40 of the anode assembly is rigidly coupled to a shaft 70 and rotor 74 via the elongated neck portion 50. The rotor 74 is coupled to an induction motor 80 for rotating the shaft and anode assembly about the axis 60. The induction motor includes a stator 81, outside the envelope, which rotates the rotor 74 and thus the shaft. The anode is rotated at high speed during operation of the tube. It is to be appreciated that the invention is also applicable to stationary anode x-ray tubes, rotating cathode tubes, and other electrode vacuum tubes.

Figure 2:
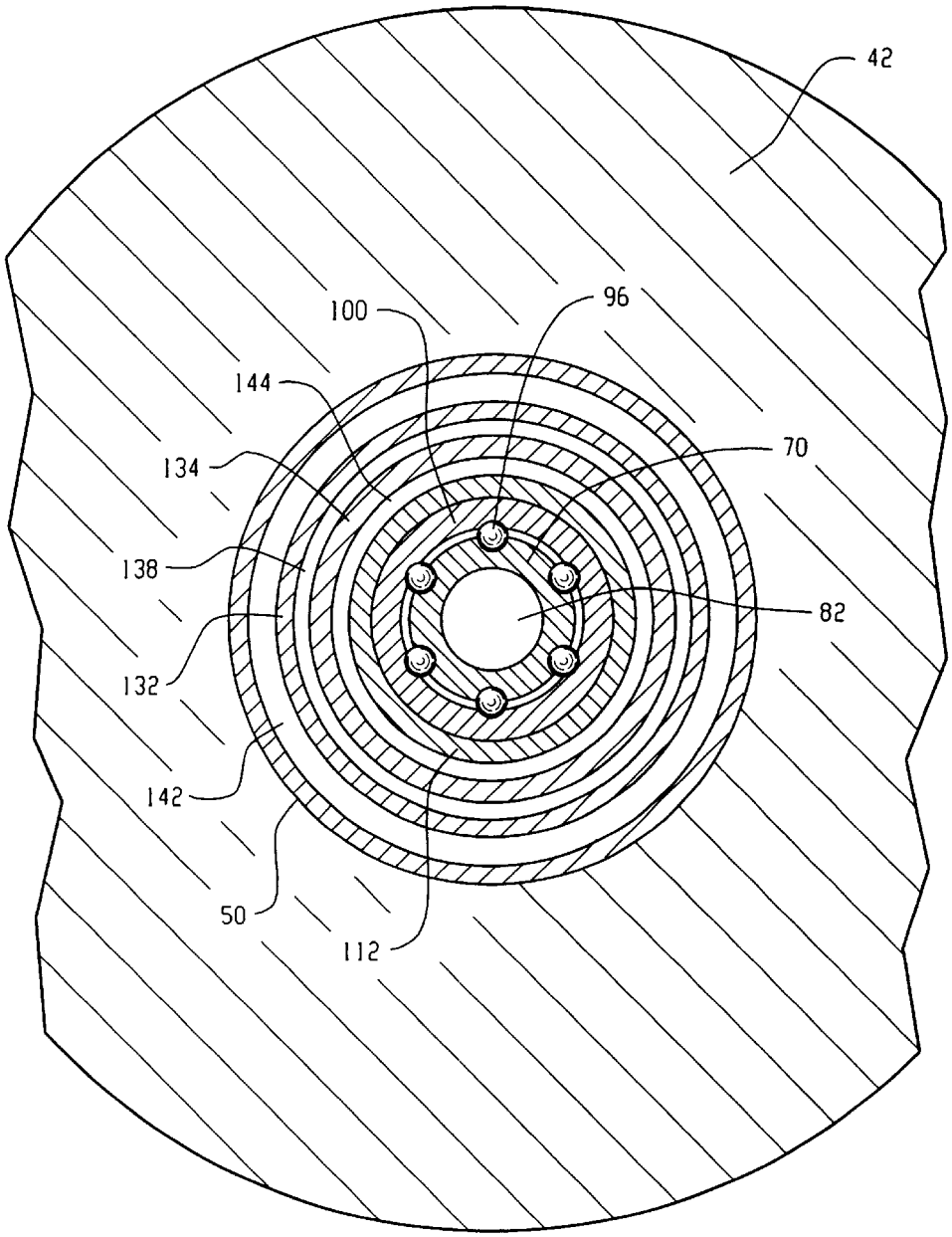
FIG. 2 is a cross sectional view of the bearing assembly, heat shield, and anode through C–C' of FIG. 1.

As shown in FIG. 1, the shaft 70 is preferably hollow, such that it defines an axial bore 82, extending into the shaft from a rearward end 84 thereof. However, the shaft may alternatively by solid, as shown in FIG. 2 or contain a core of more highly thermally conductive material.

Figure 3:
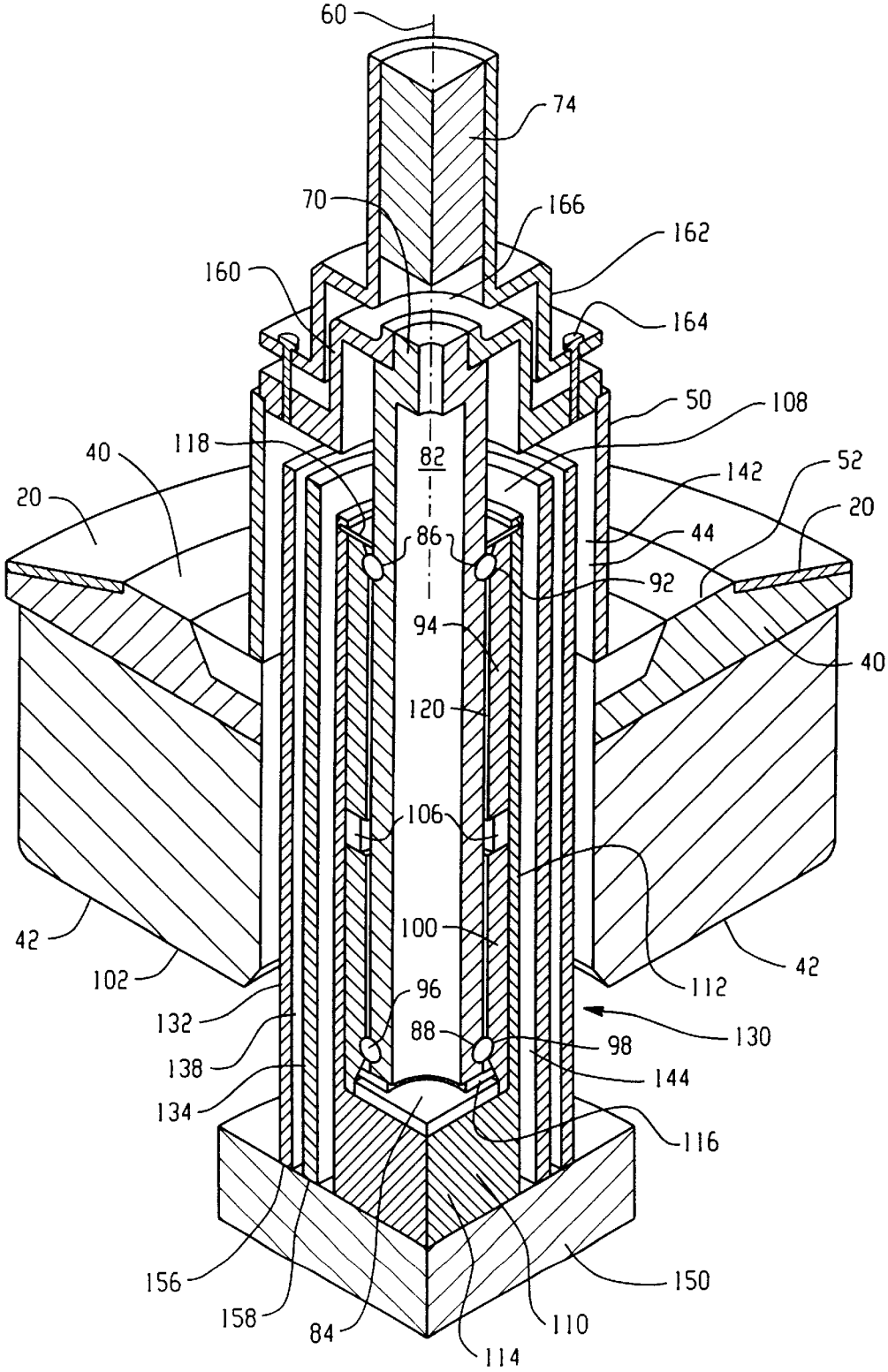
FIG. 3 is a three-quarters isometric view of the bearing assembly, heat shield, and anode of FIG. 1.
Figure 4:
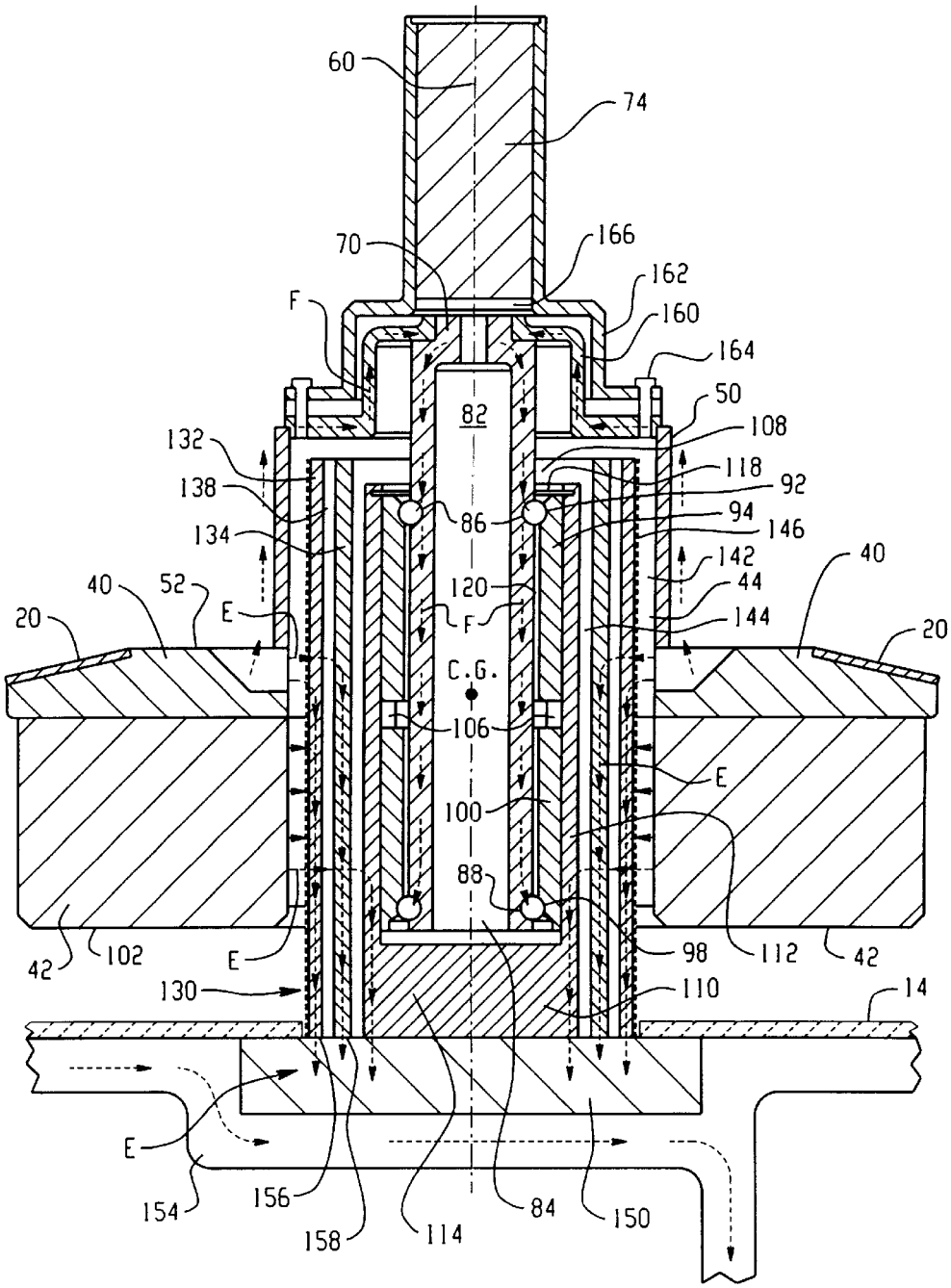
FIG. 4 is a side sectional view of a heat shield in combination with the anode and bearing assembly of FIG. 3.

With reference now to FIGS. 3 and 4, the shaft 70 defines a pair of inner bearing races 86, 88 adjacent the hollow bore 82 of the shaft. A plurality of ball or other bearing members 90 are received between the forward inner bearing race 86 and a forward outer bearing race 92 defined by an outer bearing member 94. Similarly, a plurality of ball or other bearing members 96 are received between the rearward inner bearing race 88 and a rearward outer bearing race 98 defined by an outer bearing member 100. The bearings 90, 96 provide for rotation of the anode assembly about the axis 60.

As shown in FIG. 4, the shaft 70 extends forward of the front surface 52 of the front plate and extends rearward or is approximately level with a rearward surface 102 of the rear plate 42 of the anode. In this way, the weight of anode 10 is balanced about the bearing assembly 62, with the center of gravity CG of the anode lying on the axis 60 between the forward and rear bearings 90, 96. The bearing assembly 62 passes through the bore 44 in the anode, such that a portion of the bearing assembly lies rearward of the anode center of gravity and a portion lies forward of the anode center of gravity.

The outer bearing members 94, 100 are generally cylindrical in shape and spaced apart from each other by a spacer 106. The outer bearing members 94, 100 and spacer 106 are positioned within a cavity 108 defined by a bearing housing 110. The bearing housing comprises a generally cylindrical hollow tubular portion 112 with a solid base portion 114 at a rearward end thereof. The bearing housing may be formed from a metal, such as copper or molybdenum, or ceramics, such as alumina or beryllia.

A retaining spring 116 is positioned within the cavity 108 adjacent the base portion 114 of the bearing housing 110 and a snap ring 118 is rigidly secured to the bearing housing 110 at an opposite end of the cavity 108. The retaining spring 116 and the snap ring 118 serve to frictionally sandwich and secure the outer bearing members 94 and 100 and spacer 106 within the cavity 108. A narrow vacuum gap 120 spaces the outer bearing members 94, 100 from the shaft 70.

The bearing housing 110, outer bearing members 94 and 100 and the spacer 106 are preferably made of copper, although other suitable materials could alternatively be used.

The anode is spaced from the bearing housing 110 by a heat shield 130. Thus, heat which is radiated through the vacuum by the anode towards the bearings is largely or significantly intercepted by the heat shield. As can be seen from FIGS. 3 and 4, the anode of the present x-ray tube surrounds the bearing assembly. Specifically, the target area 20 is longitudinally spaced roughly midway between the front and rear bearings 90, 96. Heat radiated inwardly from the anode could travel in a direct line toward the bearing housing 110 if not for the heat shield 130. The heat shield thus spaces at least the target portion 20 of the anode from the bearing assembly, and preferably also the entire anode is shielded from a direct view of the bearing housing, particularly the front plate 40 and back plate 42.

Figure 5:
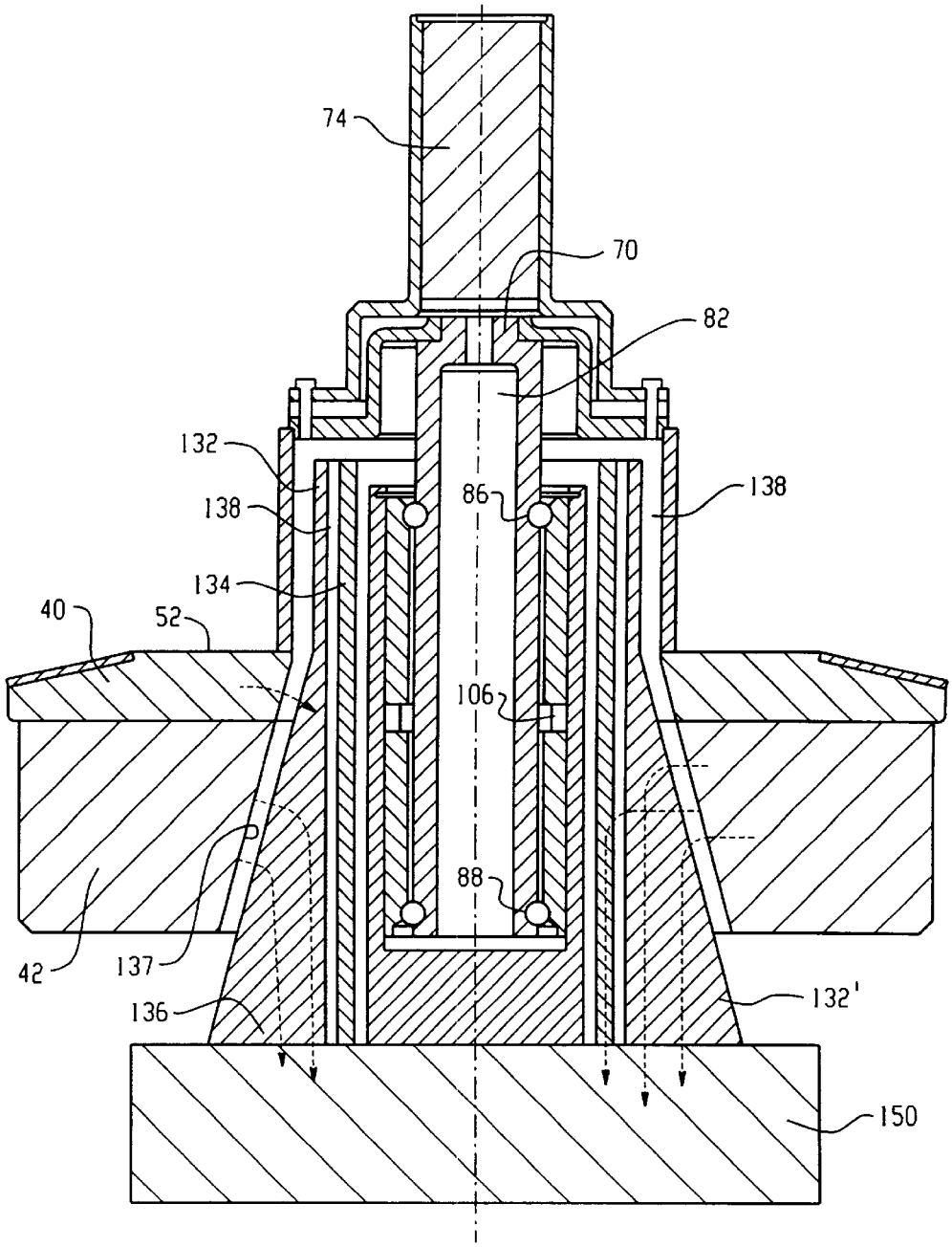
FIG. 5 is a side sectional view of a second embodiment of a heat shield in combination with the anode and bearing assembly of the x-ray tube of FIG. 1.

The heat shield preferably comprises one or more concentric hollow tubes or cylinders 132, 134. Two cylinders 132, 134 are shown in FIGS. 3 and 4, although it will be appreciated that any number of cylinders may be used. Further, while the cylinders are shown as having a circular cross section centered on the axis 60 of the x-ray tube, other configurations, such as elliptical, octagonal, or other cross sections may alternatively be employed. In yet another embodiment, the diameter of the outer tube 132' tapers from a large diameter adjacent a rearward end 136 to a smaller diameter at a forward end, increasing the value of the view factor between the target and the heat shield, as shown in FIG. 5. Preferably, the tube 132' follows the contour of the anode inner surface 137. FIG. 5 shows the thickness of the outer tube 132' increasing towards the rear end 136 although it will be appreciated that the outer tube may be of the same thickness throughout its length.

A vacuum gap 138 spaces the inner and outer cylinders 132, 134 such that any heat flow between the cylinders is primarily by radiation through the vacuum rather than by conduction. Similarly, a vacuum gap 142 spaces the anode 10 from the outer cylinder 132 and a vacuum gap 144 separates the inner cylinder 134 from the bearing housing 110. The three vacuum gaps 138, 142, 144, in combination with the cylinders 132, 134, thus act as a heat shield and heat removal system which reduces the heat flowing to the bearing housing and ultimately to the bearings. It will also reduce the heat which flows to the bearings from the anode by conduction through the anode neck 50 and along the shaft 70 as shown by arrows F in FIG. 4.

The outermost shield cylinder 132 (i.e., the one closest to the anode), is preferably formed from molybdenum, tungsten, or other heat resistant material. By "heat resistant," it is meant that the material can withstand high temperatures of around 800–1000° C. without significant deformation. The inner cylinder, and any subsequent cylinders, are generally subject to less heat, and thus may be formed of materials less capable of withstanding heat, but with higher thermal conductivity such as copper or a copper alloy, e.g., a copper-beryllium alloy, although molybdenum may be used for all cylinders.

Figure 6:
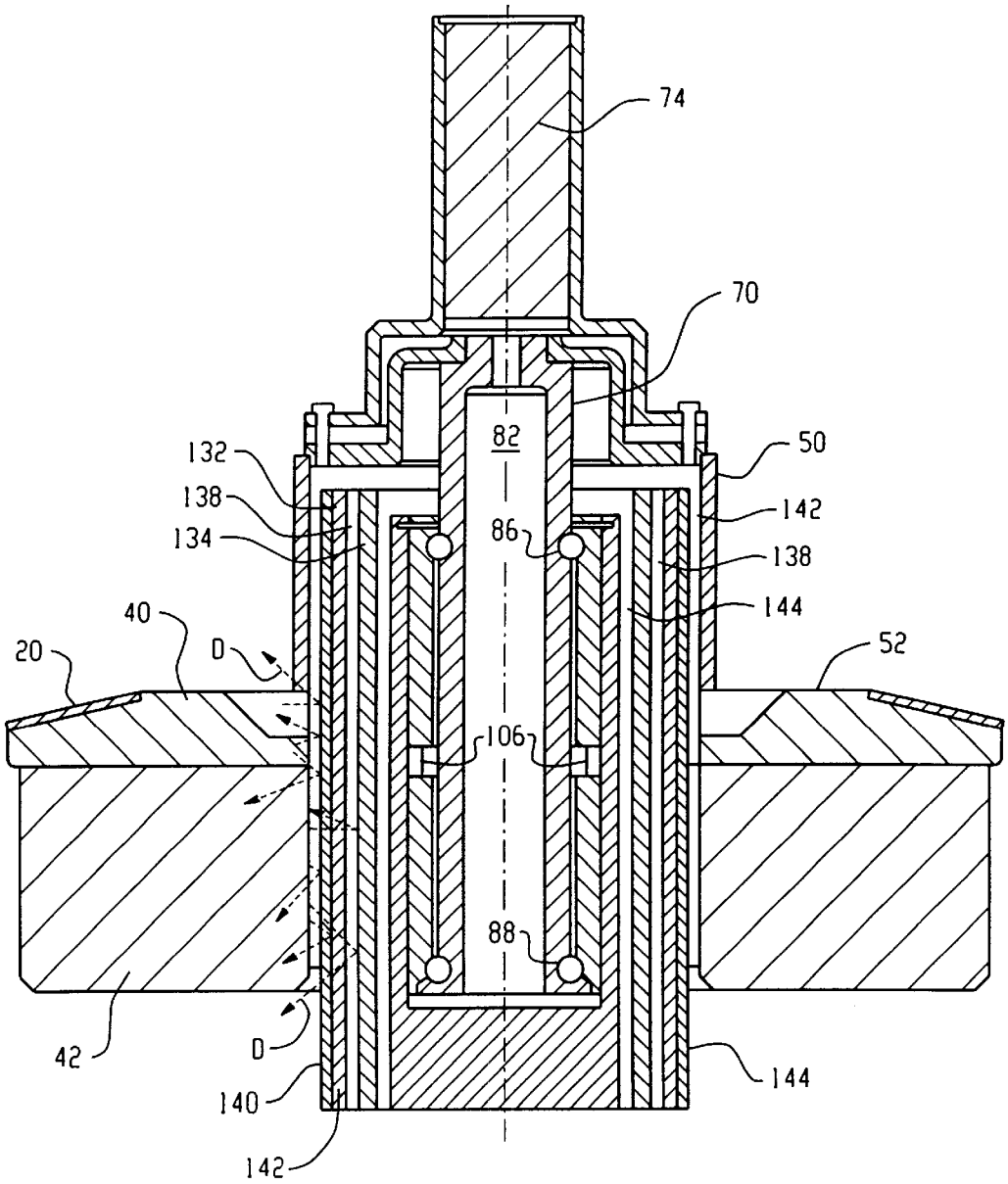
FIG. 6 is a side sectional view of a third embodiment of a heat shield in combination with the anode and bearing assembly of the x-ray tube of FIG. 1.

Alternatively, the surface of one or more of the cylinders 132, 134 is coated or laminated with a heat resistant material, as shown in FIG. 6. For example, the outer cylinder 132 has an outer layer 140 of a heat resistant material, such as molybdenum, and an inner layer 142 of a heat conductive material, such as copper or copper-beryllium alloy. By "heat conductive," it is meant that the material forms a thermal pathway which is substantially more conducive to the transfer of heat than the surrounding vacuum.

In one preferred embodiment, shown in FIG. 6, at least an outer surface 144 of the outer cylinder is reflective (e.g., polished metal) so that heat is at least partially reflected away from the bearings as shown by arrows D.

In another preferred embodiment, shown in FIG. 4, an emissive coating 146 is applied to the surface of the cylinders 132, 134, or outer cylinder 132 alone, to increase heat transfer between the target and the cylinder. The emissive coating absorbs heat radiated from the anode 10 to the heat shield. The heat is conducted through the emissive coating to the cylinder and carried along the cylinder by conduction, as shown by arrows E in FIG. 4. The emissive coating is preferably formed from a thermally conductive, grainy material, such as carbon black, which is painted or otherwise deposited on the outer surface of the cylinder 132.

In this embodiment and in the embodiment shown in FIG. 5, the outer cylinder 132, and optionally also the inner cylinder 132 act as a heat sink, carrying the heat away from the anode. In this embodiment, the cylinders are preferably formed from a thermally conductive material or are at least formed in part from a thermally conductive material, such as copper, and are mounted or otherwise thermally connected to a cold plate or cooling block 150 or other heat sink outside the envelope 14. Even relatively poor thermal conductors, such as molybdenum, will conduct heat away from the bearing assembly if connected to a heat sink.

As shown in FIG. 4, the cylinders are preferably brazed or otherwise rigidly connected directly to the cold plate. Heat is conducted via the cylinders 132, 134 to the cold plate 150 and thence to a cooling medium 154, such as oil or air, as shown by arrows E. In the embodiment of FIG. 4 the two cylinders are separately welded or otherwise thermally connected to the cooling block 150 at their rearward ends 156, 158 and are thus spaced from each other by the cold plate. This limits the amount of heat transferred by conduction from the outer cylinder 132 to the inner cylinder 134 and from the inner cylinder to the bearing assembly. Cooling oil flows over the block, carrying the heat away from the block.

The base 114 of the bearing housing 110 is also welded or otherwise connected to the cooling block 150. The housing base 114 is preferably spaced from the inner concentric cylinder 134 such that there is no direct conductive path for heat from the cylinders 132 to the bearing housing other than through the cooling block 150. Optionally, the base 114 can have an extension of highly thermally conductive material extending into the shaft cavity 82, but spaced from this shape. As can be seen from FIG. 4, some heat reaches the bearing housing from the cylinders by radiation, but this is much less than would occur without the cylinders present. Additionally, having more than one cylinder reduces the amount of radiated heat reaching the bearing housing since both cylinders are connected to the heat sink and are each contributing to heat removal. The amount of heat radiated by the outer cylinder 132 is less than that reaching the outer cylinder by radiation, and in turn, the inner cylinder 134 radiates less heat than it receives from the outer cylinder, such that the amount of radiated heat reaching the bearing housing is much less than that impinging on the outer cylinder.

It is also contemplated that both methods of heat removal may be employed at the same time, i.e., reflection of a first portion of the heat striking the cylinders 132, 134 and conduction of a second portion of the heat to the cooling medium. Thus, the cylinders shown in FIG. 6 are preferably also connected to a cold block 150 of the type shown in FIGS. 4 and 5.

As shown in FIG. 4, and noted above, some heat from the anode assembly 10 still reaches the bearings 90, 92 via a thermally conductive path shown by arrows F. More specifically, arrowed path F begins at a peripheral edge of the anode 10 which comes in contact with the electrons dissipated from the cathode filament and travels along the elongated neck portion 50 of the anode to the shaft 70. Arrowed path F runs along the shaft substantially parallel with the axis 60 of rotation of the shaft 70 to the bearing races 86, 88 and thence to the bearings 90, 92. For purposes of this invention, the term "thermally conductive path" and derivations thereof includes a path by way of which heat is transferred between two points other than a path through a vacuum, air, or gas.

The proportion of the heat following this path can be minimized by making the cross sectional area of the path as small as possible and/or making the path length as long as possible. In the embodiment of FIG. 4, a reduced cross section is achieved by making the elongated neck portion 50 of a relatively narrow cross section and making the shaft hollow 70. Additionally, the path length is increased by connecting the neck 50 to the shaft 70 through a relatively narrow cup portion 160, which extends forward from the neck 50 and thus increases the length of the shaft. Some of the heat is carried away from the neck portion 50 by a second cup portion 162, which is bolted to the first cup portion by bolts 164, but is otherwise spaced from the first cup portion by a vacuum space 166. This heat travels through the second cup portion 162 to the rotor 74 and is radiated therefrom into the surrounding vacuum chamber 12.

By using a heat shield, the thermal stress placed on the bearings 90, 92 is reduced and evaporation of bearing lubricant is also reduced, thereby extending the operational life of the bearings and thus the operational life of the x-ray tube 1.

In operation, the stator 81 (FIG. 1) rotates the rotor 74, which is rigidly attached to the anode 10. The anode 10 is in turn rigidly attached to the shaft 70. As such, the anode 10 and shaft 70 are both rotated about the axis 60 while supported by the bearing assembly 62. The bearings 90, 96 are rotated via an inner bearing race rotation by shaft 70. Inner bearing race rotation involves rotating the inner races 86, 88 (FIG. 3) of the bearing assembly 62 while maintaining the outer races 92, 98 in a stationary position. As the inner races 86, 88 are defined by the shaft 70, inner bearing race rotation is achieved by rotating the shaft 70. Inner bearing race rotation minimizes surface speeds leading to wear on the bearings 90, 96 since a single rotation of the anode 10 causes less movement with respect to the bearings than outer bearing race rotation, due to the relative circumferences of the shaft and outer bearings, and thus prolongs the life of the x-ray tube 10.

Figure 7:
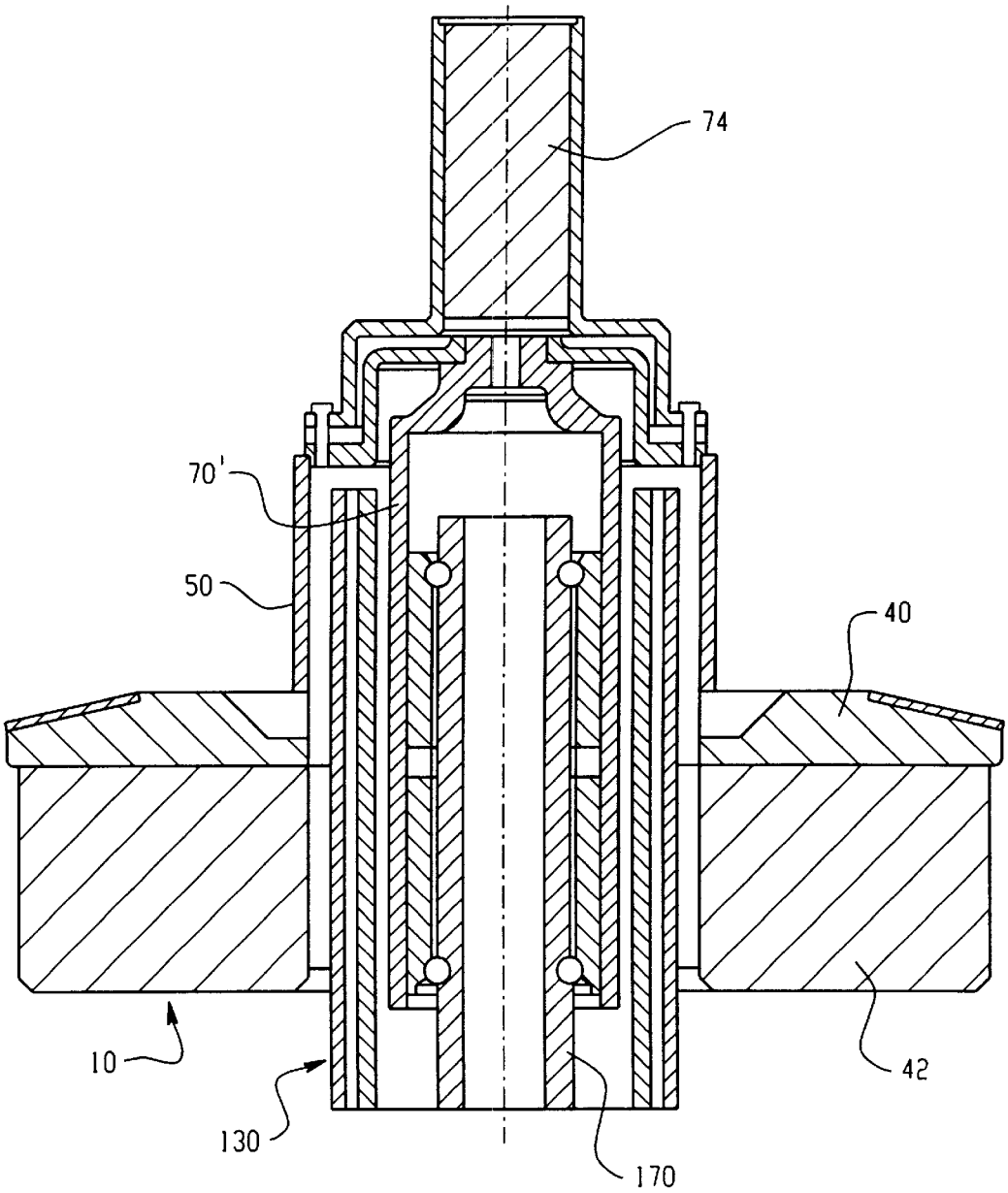
FIG. 7 is a sectional view of a fourth embodiment of an anode and bearing assembly for an x-ray tube, according to the present invention.

However, it is also contemplated that an x-ray tube employing an outer bearing race rotation may be used, as shown in FIG. 7. In such an embodiment, a hollow shaft 70' rotates around an inner stationary bearing shaft 170. In this embodiment, the heat shield 130 is interposed between the hollow rotating shaft 70' and the anode 10. The bearing shaft 170 may be hollow, as shown in FIG. 7, or solid. It is preferably mounted to the frame at its rearward end or to a heat sink, such as the cold plate 150.

Without intending to limit the scope of the invention, the following examples show the improvements which may be achieved in bearing race temperatures using the heat shield according to the present invention.

EXAMPLES

The effect of one or more heat shields on the bearing race temperatures was determined by comparing the temperature profile of a system with a single heat shield (FIG. 8A), the temperature profile a system with two concentric heat shields (FIG. 8B), of the type shown in FIG. 4, and a system with two concentric heat shields, the outer one being expanded (FIG. 8C), of the type shown as shown in FIG. 5. The temperatures of the three systems were determined by computer modeling techniques, using Finite Element Analysis. A 1200° C. heat source was modeled in this location of the anode. The radiant and conductive heat transfers were mathematically modeled.

Figure 8A:
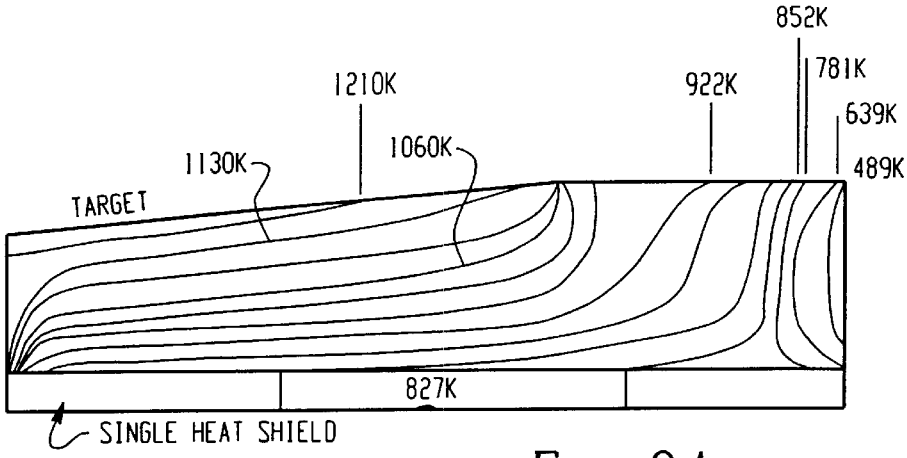
FIGS. 8A, 8B, and 8C show computer-generated plots of bearing temperatures in an x-ray tube with a single heat shield (FIG. 8A), a double heat shield (FIG. 8B) and a heat shield with an tapered outer shield and an untapered inner shield (FIG. 8C).
Figure 8B:
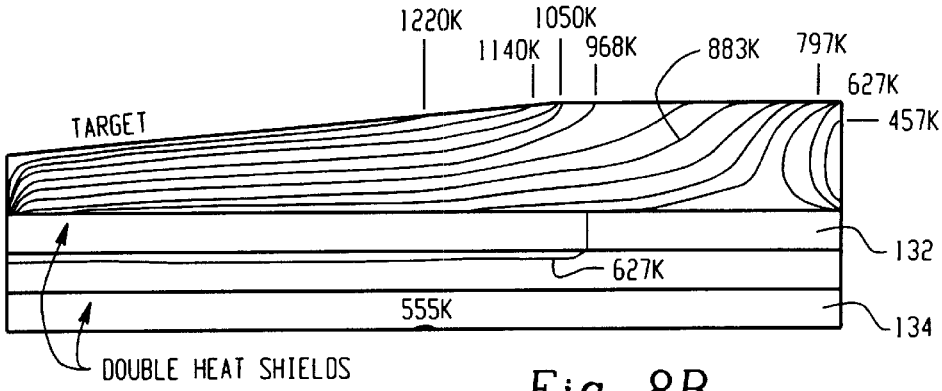
Figure 8C:
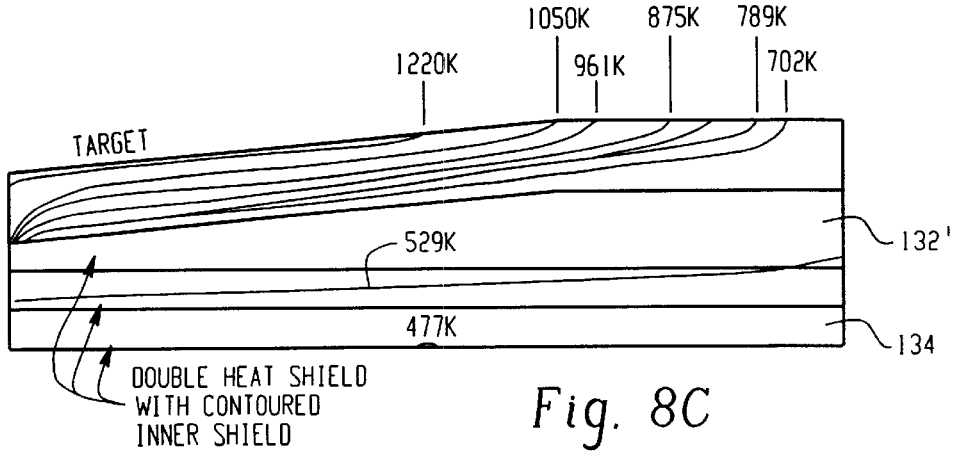

With reference to FIGS. 8A, 8B, and 8C, the temperature profiles of the bearing assemblies operated under these conditions show that the midpoint of the bearing housing (midway between bearing races) had a temperature of 872 K when only a single heat shield cylinder was used (FIG. 8A). With two concentric heat shields (FIG. 8B), the equivalent temperature was 555 K, and with a tapered outer cylinder (FIG. 8C), the equivalent temperature was 477 K. Thus, two heat shields offer a significant improvement over a single heat shield. With a tapered heat shield, an even greater improvement is realized. Accordingly, it can be expected that the x-ray tubes of the present invention may be run for a longer time than a conventional x-ray tube, before the lubricant evaporates from the bearing races.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. An x-ray tube comprising:

an envelope which encloses an evacuated chamber;

a cathode disposed within the chamber for providing a source of electrons;

an anode disposed within the chamber positioned to be struck by the electrons and generate x-rays;

a bearing assembly surrounded by the anode, the bearing assembly including a stationary portion and a rotatable portion, the rotatable portion being connected with the anode and rotating with the anode relative to the stationary portion during operation of the x-ray tube; and a heat shield between the bearing assembly and the anode which reduces the radiative transfer of heat from the anode to the bearing assembly, the heat shield including a first generally cylindrical body and a second generally cylindrical body spaced from the first generally cylindrical body by a vacuum gap, the first and second generally cylindrical bodies being disposed between the target portion of the anode and the bearing assembly.

2. The x-ray tube of claim 1, wherein the cylindrical bodies are concentrically arranged about the bearing assembly.

3. The x-ray tube of claim 1, wherein the cylindrical body closest to the anode is contoured such that it follows a profile of an adjacent surface of the anode.

4. The x-ray tube of claim 1, further including an emissive coating, on an outer surface of at least one of the generally cylindrical bodies, which absorbs heat radiated to the at least one generally cylindrical body from the anode.

5. The x-ray tube of claim 4, wherein the emissive coating includes carbon black.

6. The x-ray tube of claim 1, wherein at least one of the cylindrical bodies includes a first layer of a heat resistant material closest to the anode and a second layer of a thermally conductive material furthest from the anode.

7. An x-ray tube comprising:

an envelope which encloses an evacuated chamber;

a cathode disposed within the chamber for providing a source of electrons;

an anode disposed within the chamber positioned to be struck by the electrons and generate x-rays;

a bearing assembly surrounded by the anode, the bearing assembly including a stationary portion and a rotatable portion, the rotatable portion being connected with the anode and rotating with the anode relative to the stationary portion during operation of the x-ray tube; and two generally cylindrical bodies which are spaced from each other, the two generally cylindrical bodies being spaced from a target portion of the anode by a vacuum gap and disposed reduce the radiative transfer of heat from the anode to the bearing assembly.

8. The x-ray tube of claim 7, wherein the generally cylindrical bodies space the target portion of the anode from the bearing assembly.

9. The x-ray tube of claim 7, wherein a surface of an outer of the cylindrical bodies reflects heat radiated by the anode through the vacuum gap.

10. An x-ray tube comprising:

an envelope which encloses an evacuated chamber;

a cathode disposed within the chamber for providing a source of electrons;

an anode disposed within the chamber positioned to be struck by the electrons and generate x-rays;

a bearing assembly surrounded by the anode; and a heat shield between the bearing assembly and the anode which reduces the radiative transfer of heat from the anode to the bearing assembly, the heat shield including two generally cylindrical bodies which are thermally connected with a heat sink such that heat radiated to the cylindrical bodies from the anode flows to the heat sink.

11. An x-ray tube comprising:

an envelope which encloses an evacuated chamber;

a cathode disposed within the chamber for providing a source of electrons;

an anode disposed within the chamber positioned to be struck by the electrons and generate x-rays;

a bearing assembly surrounded by the anode; and a heat shield between the bearing assembly and the anode which reduces the radiative transfer of heat from the anode to the bearing assembly, the heat shield including a generally cylindrical body which includes a first layer of a heat resistant material closest to the anode and a second layer of a thermally conductive material furthest from the anode, the heat resistant material including molybdenum and the thermally conductive material including copper.

12. An x-ray tube comprising:

an envelope which defines an evacuated chamber;

a cathode disposed within the chamber for providing a source of electrons;

an anode disposed within the chamber positioned to be struck by the electrons and generate x-rays;

a bearing assembly concentrically aligned with the anode, the bearing assembly including a rotating portion connected with the anode by a shaft and a stationary portion thermally connected with a heat sink outside the envelope;

a first generally concentric heat shield between the anode and the bearing assembly; and a second generally concentric heat shield between the first heat shield and the bearing assembly.

13. The x-ray tube of claim 12, wherein the heat shields are connected to the heat sink, such that heat radiated to the heat shields from the anode is conducted through the heat shields to the heat sink and away from the bearing assembly.

14. The x-ray tube of claim 13, wherein the heat shields are spaced from the stationary portion of the bearing assembly by the heat sink such that conductive heat transfer from the heat shields to the bearing assembly is minimized.

15. A method of operating an x-ray tube, the method comprising:

supporting a rotating anode on a bearing assembly, the bearing assembly being received through a central opening in the anode such that the bearing assembly extends forward and rearward of a center of gravity of the anode;

interposing at least two heat shields between the anode and the bearing assembly;

operating the x-ray tube such that the anode generates x-rays and radiates heat towards the bearing assembly;

intercepting a portion of the heat radiated from the anode with an outer of the heat shields;

conducting a portion of the intercepted heat away from the heat shield to a heat sink; and intercepting heat from the outer heat shield with an inner heat shield.

16. The method of claim 15, further including:

reflecting a portion of the intercepted heat towards the anode.

17. An x-ray tube comprising:

an evacuated housing;

a cold plate mounted to the housing;

a cylindrical bearing assembly mounted to the cold plate;

an anode mounted on the bearing assembly for rotation relative to the housing;

a first generally cylindrical heat shield mounted to the cold plate, the first heat shield extending between and spaced from the anode and the bearing assembly to intercept radiant thermal energy traveling from the anode toward the bearing assembly; and a cathode disposed in the housing opposite to the anode.

18. An x-ray tube comprising:

an evacuated housing;

a cold plate mounted to the housing;

a cylindrical bearing assembly mounted to the cold plate;

an anode mounted on the bearing assembly for rotation relative to the housing;

a first generally cylindrical heat shield mounted to the cold plate, the first heat shield extending between and spaced from the anode and the bearing assembly to intercept radiant thermal energy traveling from the anode toward the bearing assembly;

a second generally cylindrical heat shield mounted to the cold plate, the second heat shield being concentric with and spaced from the first heat shield and being disposed between the anode and the first heat shield; and a cathode disposed in the housing opposite to the anode.

19. The x-ray tube of claim 18, wherein the anode is mounted surrounding the bearing assembly, the second heat shield being contoured in accordance with an inner surface of the anode and increasing in thickness adjacent the cold plate.

20. The x-ray tube of claim 18, further including:

a coating on an outer surface of the second heat shield facing the anode.

* * * * *